US008627795B2

(12) United States Patent
Kapp et al.

(10) Patent No.: US 8,627,795 B2
(45) Date of Patent: Jan. 14, 2014

(54) CAMSHAFT ARRANGEMENT

(75) Inventors: Matthias Kapp, Oak Park, MI (US); Craig Dupuis, Windsor (CA); Inhwa Chung, Lasalle (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/500,335

(22) PCT Filed: Oct. 4, 2010

(86) PCT No.: PCT/EP2010/064751

§ 371 (c)(1),
(2), (4) Date: Apr. 5, 2012

(87) PCT Pub. No.: WO2011/042391

PCT Pub. Date: Apr. 14, 2011

(65) Prior Publication Data

US 2012/0192820 A1 Aug. 2, 2012

Related U.S. Application Data

(60) Provisional application No. 61/248,616, filed on Oct. 5, 2009.

(51) Int. Cl.
*F01L 1/34* (2006.01)

(52) U.S. Cl.
USPC ..... 123/90.17; 123/90.15; 123/90.6; 29/888.1; 464/160

(58) Field of Classification Search
USPC ..... 123/90.15, 90.17, 90.6; 29/888.1; 464/1, 2, 160
See application file for complete search history.

(56) References Cited

U.S. PATENT DOCUMENTS

| | | | | |
|---|---|---|---|---|
| 6,725,817 | B2 | 4/2004 | Methley et al. | |
| 7,444,968 | B2 * | 11/2008 | Lancefield et al. | 123/90.17 |
| 2005/0226736 | A1 | 10/2005 | Lancefield et al. | |
| 2007/0137598 | A1 | 6/2007 | Fritz et al. | |

FOREIGN PATENT DOCUMENTS

| | | |
|---|---|---|
| DE | 19757504 | 7/1999 |
| DE | 10344816 | 9/2008 |
| DE | 102008019746 | 10/2009 |
| EP | 1803904 | 7/2007 |

(Continued)

*Primary Examiner* — Ching Chang
(74) *Attorney, Agent, or Firm* — Volpe and Koenig, P.C.

(57) ABSTRACT

A camshaft arrangement (1) for changing the relative angle position of at least one cam of a camshaft (2) relative to a second cam of the camshaft (2), wherein the arrangement includes an angular adjustment device (3) having a stator (4) and a rotor (5) which is arranged such that it can be rotated relative thereto. The rotor (5) is connected to a shaft (6) in a rotationally fixed manner, the stator (4) is connected to a hollow shaft (7) in a rotationally fixed manner, and the shaft (6) and the hollow shaft (7) are arranged concentrically to one another. The at least one first cam is connected to the shaft (6) in a rotationally fixed manner and the at least one second cam is connected to the hollow shaft (7) in a rotationally fixed manner. In order to establish a fixed connection between stator and hollow shaft, which requires little space, the rotationally fixed connection between stator (4) and hollow shaft (7) is established via a cover element (8) that is rigidly connected to the stator (4), wherein the cover element (8) includes a borehole (9) for receiving a cylindrical section (10) of the hollow shaft (7) and a force-fitting and/or form-fitting connection between cover element (8) and hollow shaft (7) is formed.

15 Claims, 5 Drawing Sheets

(56) References Cited

FOREIGN PATENT DOCUMENTS

| | | |
|---|---|---|
| EP | 1945918 | 2/2009 |
| GB | 2369175 | 5/2002 |
| GB | 2423565 | 8/2006 |
| GB | 2424254 | 9/2006 |
| GB | 2432645 | 5/2007 |
| GB | 2433974 | 7/2007 |
| WO | 2008028902 | 3/2008 |
| WO | 2009098497 | 8/2009 |

* cited by examiner

CAMSHAFT ARRANGEMENT

FIELD OF THE INVENTION

The invention relates to a camshaft arrangement for varying the relative angle position of at least one first cam of a camshaft relative to a second cam of the camshaft, wherein the arrangement comprises an angle adjustment device which has a stator and a rotor which is arranged so as to be rotatable relative to said stator, wherein the rotor is connected in a rotationally fixed manner to a shaft, wherein the stator is connected in a rotationally fixed manner to a hollow shaft, wherein the shaft and the hollow shaft are arranged concentrically with respect to one another, wherein the at least one first cam is connected in a rotationally fixed manner to the shaft and wherein the at least one second cam is connected in a rotationally fixed manner to the hollow shaft.

BACKGROUND

Camshaft arrangements of this type are known as "cam in cam" systems. By means of these, it is possible for at least two cams of the camshaft—usually a number of respective cams—to be rotated relative to one another on the camshaft in order to vary the control times of the gas exchange valves of an internal combustion engine. Such camshaft systems are described for example in EP 1 945 918 B1, in GB 2 423 565 A and in WO 2009/098497 A1.

It is known to produce the rotationally fixed connection between the stator or a part thereof and the hollow shaft by means of a screw connection, such as is typical for the connection between the inner shaft and the rotor. A disadvantage of this solution is that it requires a relatively large radial installation space. This is a problem in particular if the internal combustion engine is of OHC (overhead camshaft) design. Furthermore, this connection increases the weight of the arrangement.

Furthermore, in camshaft adjusting systems, it has become known for the rotationally fixed connection to be produced by means of one or more pins which are pressed into the arrangement (in this regard, see GB 2 423 565 A, FIG. 1 and the pin 38 in said figure). Such a solution is however susceptible to component failure. Furthermore, with this solution, play may relatively easily form over the course of time, which manifests itself in wear and deformation of the components.

Accordingly, in generic adjusting devices, the connection of the hollow shaft to the stator constitutes a weak point which, in the event of failure, can lead to a malfunction of the camshaft arrangement.

The objective to be addressed by the present invention is that of further developing a camshaft arrangement of the type mentioned in the introduction such that the connection between the stator and the hollow shaft is improved. Here, in particular a radially space-saving solution should be sought since the available installation space is very limited.

SUMMARY

The solution to meeting this objective according to the invention is characterized in that the rotationally fixed connection between the stator and hollow shaft is produced by means of a cover element which is fixedly connected to the stator, wherein the cover element has a bore for receiving a cylindrical portion of the hollow shaft, and wherein a non-positively locking and/or cohesive connection is provided in the cylindrical contact surface between the cover element and hollow shaft.

The bore is preferably arranged concentrically with respect to the shaft and hollow shaft. The cover element is usually screwed to the stator.

The non-positively locking connection may be produced by means of an interference fit or shrink fit between the bore and cylindrical portion. To ensure that an adequate contact surface for transmitting an adequately high torque is provided, one particularly preferred embodiment provides that the cover element has a substantially constant thickness in the axial direction of the shaft and hollow shaft, wherein the cover element is of increased thickness in the region of the bore in order to increase the length of the cylindrical contact surface. Here, the cover element preferably has a planar face side, wherein the portion of increased thickness then extends into the interior of the arrangement.

The cohesive connection may be produced by means of a welded connection of the cover element and hollow shaft. In particular, the welded connection may be a laser-welded or electron beam-welded connection.

The cohesive connection may also be produced by means of a soldered connection of the cover element and hollow shaft. This soldered connection is envisaged in particular as a brazed connection.

It is furthermore possible for the cohesive connection to be produced by means of an adhesive connection of the cover element and hollow shaft.

It is also possible for both a non-positively locking connection and also a cohesive connection to be provided between the cover element and hollow shaft.

The shaft is preferably connected to the rotor by means of a screw connection, wherein the screw connection preferably comprises a central screw arranged coaxially with respect to the shaft.

The angle adjustment device is preferably designed as a hydraulic adjustment device.

With said embodiment, it is possible to produce a very secure connection, which takes up little space, between the stator and hollow shaft.

BRIEF DESCRIPTION OF THE DRAWINGS

The drawings show an exemplary embodiment of the invention, in which.

DETAILED DESCRIPTION OF THE PREFERRED EMBODIMENTS

Figure 1:
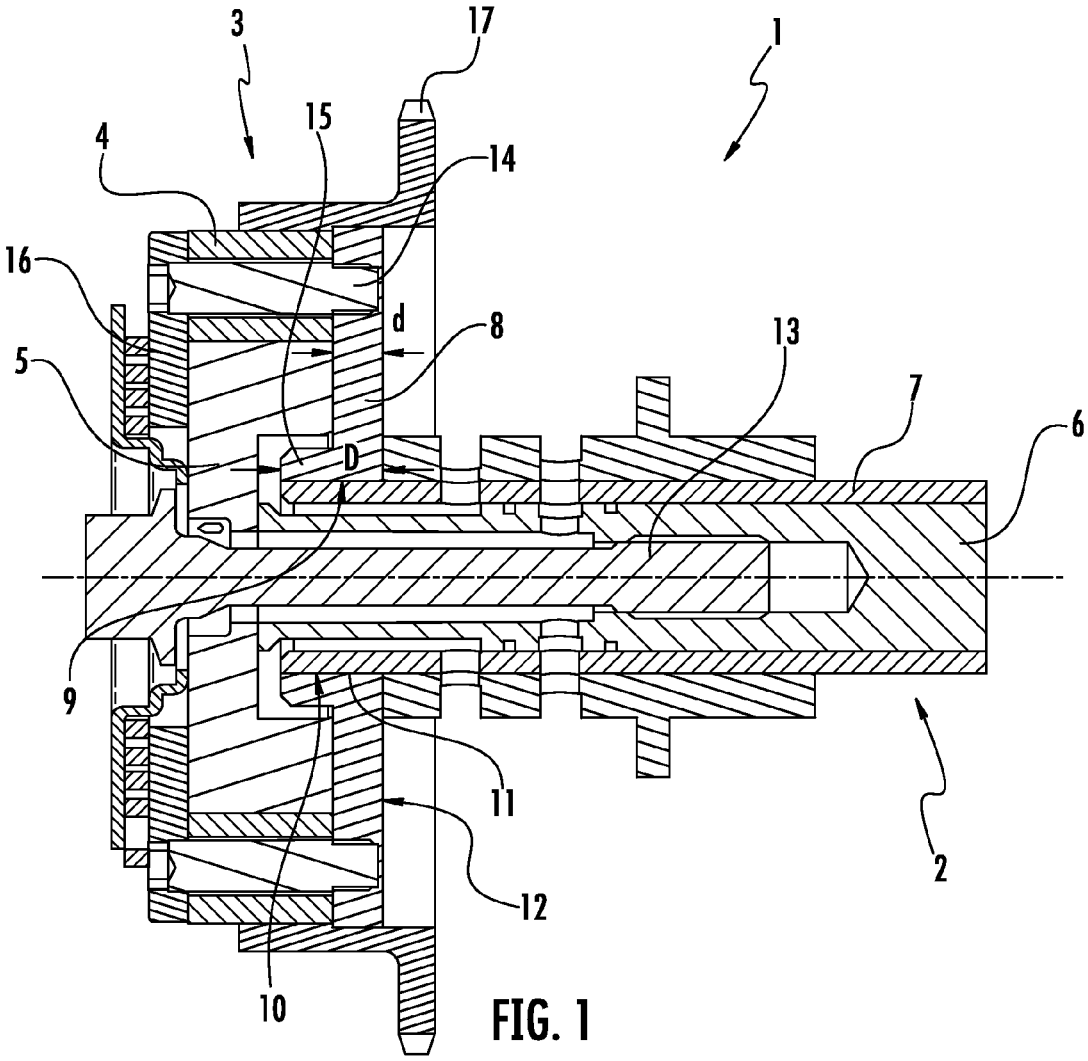
FIG. 1 shows the radial section through a camshaft arrangement of an internal combustion engine, having a camshaft which is comprised of two concentric shafts, wherein the arrangement has an angle adjustment device, FIG. 2 schematically shows the profile with respect to time of the opening and closing of intake and exhaust valves of an internal combustion engine, as per a first possible actuation method, FIG. 3 schematically shows the profile with respect to time of the opening and closing of the valves as per a second possible actuation method, FIG. 4 schematically shows the profile with respect to time of the opening and closing of the valves as per a third possible actuation method, and FIG. 5 schematically shows the profile with respect to time of the opening and closing of the valves as per a fourth possible actuation method.

FIG. 1 illustrates a camshaft arrangement 1 which comprises a camshaft 2 which has cams (not illustrated) which interact in a known way with gas exchange valves in order to control the gas exchange in an internal combustion engine.

An arrangement of this type serves for varying the valve control times of an internal combustion engine. Use is usually made of hydraulically actuated adjusters.

In a first driving strategy, the control of an intake valve is varied relative to an exhaust valve—or vice versa—this usually being expedient in SOHC (single overhead camshaft) or OHV (overhead valves) engine types. This permits the variation of the intake phase or of the exhaust phase using a single camshaft.

A second driving strategy provides that the control times of one set of intake valves are changed relative to another set of valves using a single intake camshaft. This may be used if two or possibly three intake valves are provided per cylinder, and it is sought to vary the control times of one of the intake valves relative to the others on one cylinder.

In a third driving strategy, the control times of one set of exhaust valves are varied relative to another set of valves using a single exhaust camshaft. This may be used if two or possibly three exhaust valves are provided per cylinder, wherein it is sought to vary the control times of one exhaust valve relative to the others on one cylinder.

Here, the camshaft arrangement 1 has an angle adjustment device 3 which is connected to the camshaft 2. Cams for, for example, the intake and exhaust valves of the internal combustion engine are arranged on the camshaft. Through the use of the angle adjustment device 3, it is possible for a part of the cams to be rotated relative to another part of the cams. For this purpose, the camshaft 2 is comprised of two coaxially arranged shaft elements, specifically of a shaft 6 and of a hollow shaft 7 in which the shaft 6 is arranged coaxially. The cams situated on the camshaft 2 are connected in a rotationally fixed manner either to the shaft 6 or to the hollow shaft 7. Details regarding this emerge from EP 1 945 918 B1.

The angle adjustment device 3 has a stator 4 and a rotor 5 which can be rotated relative to one another—in the exemplary embodiment by means of hydraulic actuation—by a defined angle. This realization of this relative rotation function is known in the prior art, reference being made by way of example to DE 103 44 816 A1. In the device described in said document, a vane wheel is provided into which vanes are formed or in which vanes are arranged. The vanes are situated in hydraulic chambers which are formed in a rotor. An adjustment of the rotor relative to the stator can be realized through corresponding charging of the respective side of the hydraulic chambers with hydraulic fluid.

The rotor 5 is connected in a rotationally fixed manner to the shaft 6, wherein a central screw 13 is used for this purpose. A secure radial and axial connection between the rotor 5 and shaft 6 is ensured by the central screw 13.

The stator 4 has a cover element 8 which is connected to the stator 4 by screws 14. The hollow shaft 7 is connected in a rotationally fixed manner to the cover element 8. Here, the rotationally fixed connection between the stator 4 and hollow shaft 7 takes place via the cover element 8 which is connected to the stator 4, in that the cover element 8 has a bore 9 for receiving a cylindrical portion 10 of the hollow shaft 7. It is provided here that a non-positively locking and/or cohesive connection is provided in the cylindrical contact surface 11 between the cover element 8 and hollow shaft 7.

For this purpose, it is provided in the exemplary embodiment as per FIG. 1 that the hollow shaft 7 is seated with its cylindrical portion 10 in the bore 9 by an interference fit. This interference fit may be produced by virtue of the cylindrical portion 10 being pressed axially into the bore 9 and/or by thermal shrinkage. The interference fit eliminates all axial and radial play between the cover element 8 and hollow shaft 7.

To provide the bore 9 with an adequately long extent in the axial direction, the cover element 8 is provided, in the region of the bore 9, with a widening 15 which extends in the axial direction. This widening serves to ensure an adequate contact length such that the connection between the cover element 8 and hollow shaft 7 by an interference fit is of adequate strength. Accordingly, the substantially homogeneous thickness d of the cover element 8 over its radial extent is increased to the value D in the region of the bore 9 due to the widening 15, with the value D being preferably 1.5 times, particularly preferably at least 2 times, the value of d.

The outer face side 12 of the cover element 8 is of substantially planar design, that is to say the widening 15 extends into the interior of the angle adjustment device 3.

On the side opposite the cover element 8, the angle adjustment device 3 is closed off by a further cover element 16. The drive of the angle adjustment device 3, and therefore of the camshaft 2, is provided in a known way via a pinion 17 by a chain (not illustrated) driven by the crankshaft of the internal combustion engine. The pinion 17 is formed here as a separate component. It may however also be formed integrally with the stator 4.

It is thereby possible to influence, that is to say adjust, the phase relationship between the cams connected in a rotationally fixed manner to the hollow shaft 7 and the cams connected in a rotationally fixed manner to the shaft 6. Here, according to the invention, the connection between the cover element 8 and the hollow shaft 7 is formed so as to be so secure that a torque adequate for effecting the actuation of the cams counter to the spring force of the gas exchange valves can be transmitted via said connection. The same self-evidently applies to the connection between the rotor 5 and the shaft 6 by the central screw 13.

The mode of operation of an internal combustion engine which is made possible by the camshaft arrangement is illustrated in FIGS. 2 to 5. The Figures each show the profile with respect to time of the opening travel imparted to a valve by a cam.

In an engine with a single camshaft (SOHC type—single overhead camshaft) or an engine of OHV (overhead valve) type, the shaft 6 actuates the exhaust valves, wherein the control of the exhaust valves can be adjusted relative to the crankshaft of the engine. Here, the actuation of the exhaust valves can be seen in the left-hand half of the Figure in FIG. 2, whereas the right-hand half of the Figure shows the actuation of the intake valves. The dashed curve profiles for the exhaust valves and the offset in the direction of the double arrow indicate that the adjustment facility of the angle adjustment device 3 is utilized for this purpose.

Figure 2:
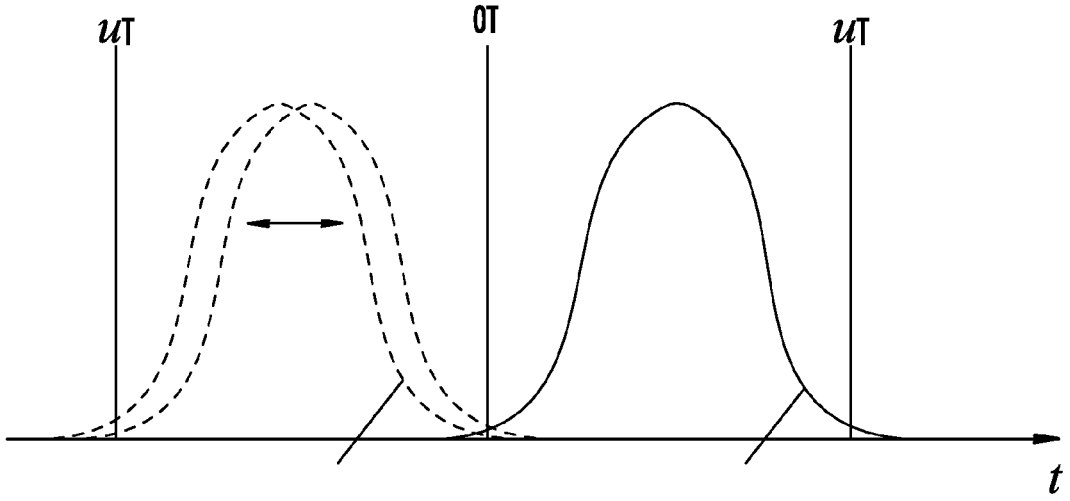

In the case of FIG. 2, this permits optimized control, that is to say opening and closing, of the exhaust valves as a function of the rotational speed and of the load state of the internal combustion engine. This advantageously leads to increased fuel efficiency and reduced emissions.

Figure 3:
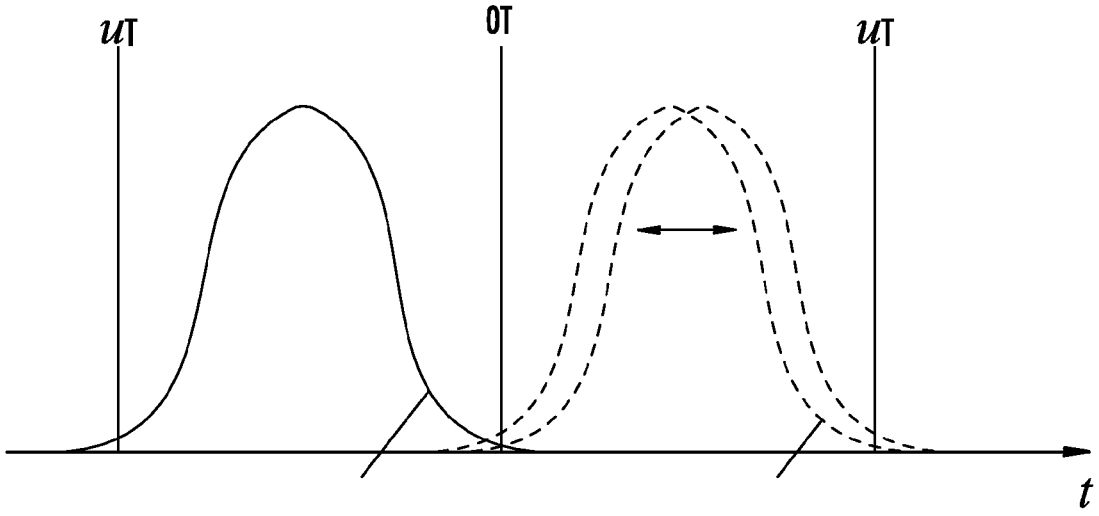

FIG. 3 shows, for the same design of engine as in FIG. 2, the appearance of the profile if the shaft 6 actuates the intake valves. Again, the actuation of the exhaust valves is shown in the left-hand half of the Figure and that of the intake valves is shown in the right-hand half of the Figure. It is now possible here—shown again by the dashed curve profiles and the double arrow—for the phase relationship of the intake valves relative to the crankshaft to be varied.

In the case of FIG. 3, this permits optimized control, that is to say opening and closing, of the intake valves as a function of the rotational speed and of the load state of the internal combustion engine. Volumetric efficiency can be improved, which leads to improved torque delivery of the engine and increased fuel efficiency and improved running behavior of the engine.

Figure 4:
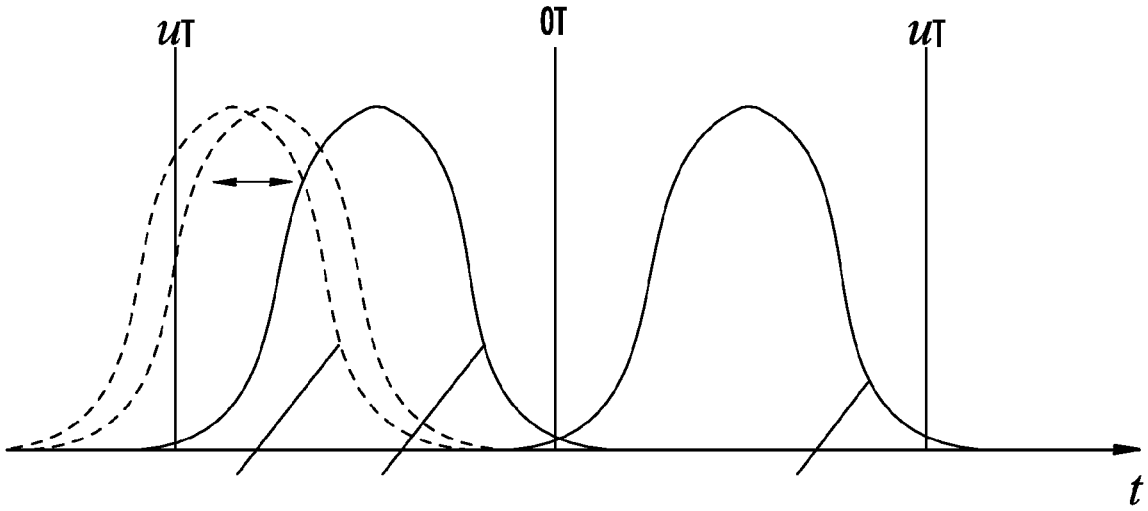

In an engine with two overhead camshafts (DOHC type), it may be provided that the shaft 6 with the cams fastened in a rotationally fixed manner thereto actuates one or more exhaust valves per cylinder, whereas the remaining exhaust valves are actuated by the hollow shaft 7 and the cams arranged in a rotationally fixed manner thereon. Such a solution is shown in FIG. 4. In this case, it is possible to realize, for each cylinder, an adjustment of the actuation of one or more of the exhaust valves relative to the other exhaust valves. It can be seen in the left-hand half of the Figure in FIG. 4 that at least one exhaust valve (see solid line) is operated with fixed control times, whereas at least one further exhaust valve (see dashed lines and double arrow) is adjustable with regard to its control times. In the present case, the intake valves are non-adjustable in terms of their control times (see right-hand half of the figure).

It is thereby possible for the duration of the opening of the exhaust valves to be varied such that the opening time of the exhaust valves can be optimized. An early opening of the exhaust valves before bottom dead center (BDC) permits a fast warm-up of the internal combustion engine, which reduces cold start emissions.

Figure 5:
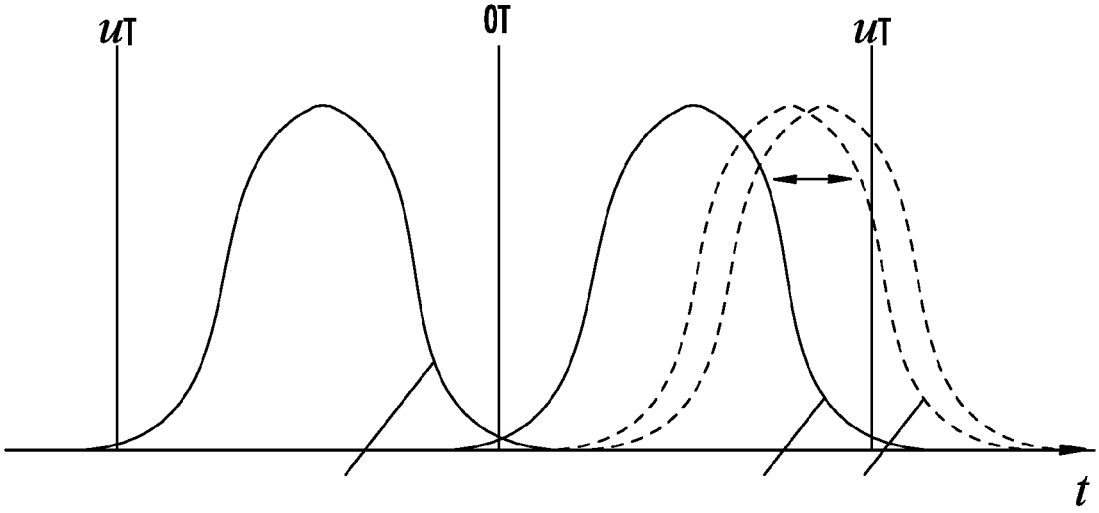

An analogous solution to FIG. 4 is depicted in FIG. 5. Here, too, a DOHC type engine is used. In this case, the shaft 6 actuates one or more intake valves per cylinder, while the other intake valves are actuated by the hollow shaft 7.

It is thereby possible in turn for control to be implemented such that the valve opening times at the intake can be varied. The solid lines in the right-hand half of the figure of FIG. 5 in turn show the control of one or more intake valves with non-variable control times, whereas the dashed lines and the double arrow indicate that temporal variation of the control of the other intake valves can be realized by means of the angle adjustment device 3.

It is thus possible here, analogously to FIG. 4, for the duration of the opening of the intake valves to be varied. Furthermore, the closing time of the intake valves can also be optimized. This may be utilized to realize a late intake valve closing (LIVC) strategy.

The closing of the intake valves after bottom dead center (BDC) makes it possible for a part of the gas to be forced back into the intake tract, which reduces the length of the compression stroke. This leads to a reduction in pumping losses of the engine and thus to improved fuel efficiency. The closing of the intake valves can be optimized as a function of the rotational speed and engine load.

LIST OF REFERENCE SYMBOLS

1 Camshaft arrangement
2 Camshaft
3 Angle adjustment device
4 Stator
5 Rotor
6 Shaft
7 Hollow shaft
8 Cover element
9 Bore
10 Cylindrical portion
11 Cylindrical contact surface
12 Face side
13 Central screw
14 Screw
15 Widening
16 Cover element
17 Pinion
d Thickness
D Thickness

The invention claimed is:

1. A camshaft arrangement for varying a relative angle position of at least one first cam of a camshaft relative to a second cam of the camshaft, comprising an angle adjustment device which has a stator and a rotor which is arranged so as to be rotatable relative to said stator, the rotor is connected in a rotationally fixed manner to a shaft, the stator is connected in a rotationally fixed manner to a hollow shaft, the shaft and the hollow shaft are arranged concentrically with respect to one another, the at least one first cam is connected in a rotationally fixed manner to the shaft and the at least one second cam is connected in a rotationally fixed manner to the hollow shaft the rotationally fixed connection between the stator and the hollow shaft is produced by a cover element which is fixedly connected to the stator, the cover element has a bore for receiving a cylindrical portion of the hollow shaft, and at least one of a non-positively locking or cohesive connection is provided at a cylindrical contact surface between the cover element and the hollow shaft.

2. The camshaft arrangement as claimed in claim 1, wherein the bore is arranged concentrically with respect to the shaft and the hollow shaft.

3. The camshaft arrangement as claimed in claim 1, wherein the cover element is screwed to the stator.

4. The camshaft arrangement as claimed in claim 1, wherein the non-positively locking connection is produced by an interference fit or shrink fit between the bore and the cylindrical portion.

5. The camshaft arrangement as claimed in claim 4, wherein the cover element has a constant thickness (d) in an axial direction of the shaft and the hollow shaft, and the cover element has an increased thickness (D) in a region of the bore in order to increase a length of the cylindrical contact surface.

6. The camshaft arrangement as claimed in claim 5, wherein the cover element has a planar face side and a widening due to the increased thickness (D) that extends into an interior of the arrangement.

7. The camshaft arrangement as claimed in claim 1, wherein the cohesive connection is produced by a welded connection of the cover element and the hollow shaft.

8. The camshaft arrangement as claimed in claim 7, wherein the welded connection is a laser-welded or electron beam-welded connection.

9. The camshaft arrangement as claimed in claim 1, wherein the cohesive connection is produced by a soldered connection of the cover element and the hollow shaft.

10. The camshaft arrangement as claimed in claim 9, wherein the soldered connection is a brazed connection.

11. The camshaft arrangement as claimed in claim 1, wherein the cohesive connection is produced by an adhesive connection of the cover element and the hollow shaft.

12. The camshaft arrangement as claimed in claim 1, wherein both the non-positively locking connection and the cohesive connection are provided between the cover element and the hollow shaft.

13. The camshaft arrangement as claimed in claim 1, wherein the shaft is connected to the rotor by a screw connection.

14. The camshaft arrangement as claimed in claim 13, wherein the screw connection comprises a central screw arranged coaxially with respect to the shaft.

15. The camshaft arrangement as claimed in claim 1, wherein the angle adjustment device comprises a hydraulic adjustment device.

* * * * *